US010364138B2

(12) United States Patent
Jarrousse et al.

(10) Patent No.: US 10,364,138 B2
(45) Date of Patent: Jul. 30, 2019

(54) FACILITY FOR PREPARING A BEVERAGE FOR TASTING AND METHOD FOR OPENING A BEVERAGE CONTAINER USING SUCH A FACILITY

(71) Applicant: 10-VINS, Nantes (FR)

(72) Inventors: Thibaut Jarrousse, Nantes (FR); Luis Da Silva, Reze (FR); Jerome Pasquet, Nantes (FR)

(73) Assignee: 10-VINS, Nantes (FR)

( * ) Notice: Subject to any disclaimer, the term of this patent is extended or adjusted under 35 U.S.C. 154(b) by 0 days.

(21) Appl. No.: 15/781,374

(22) PCT Filed: Dec. 1, 2016

(86) PCT No.: PCT/FR2016/053158
§ 371 (c)(1),
(2) Date: Jun. 4, 2018

(87) PCT Pub. No.: WO2017/098115
PCT Pub. Date: Jun. 15, 2017

(65) Prior Publication Data

US 2018/0362326 A1 Dec. 20, 2018

(30) Foreign Application Priority Data

Dec. 8, 2015 (FR) ..... 15 62002

(51) Int. Cl.
*B01F 3/04* (2006.01)
*B01F 5/04* (2006.01)
(Continued)

(52) U.S. Cl.
CPC ..... *B67D 3/0077* (2013.01); *B01F 3/04787* (2013.01); *B01F 5/0413* (2013.01);
(Continued)

(58) Field of Classification Search
CPC .. B67D 3/0077; B67D 3/0009; B67D 3/0022; B67D 3/0032; B01F 3/04787; B67B 7/24; B67B 7/28
See application file for complete search history.

(56) References Cited

U.S. PATENT DOCUMENTS 3,054,178 A * 9/1962 Heiser ..... B67B 7/24 30/406
4,723,688 A 2/1988 Munoz
(Continued)

FOREIGN PATENT DOCUMENTS

| | | |
|---|---|---|
| CN | 203000626 | 6/2013 |
| GB | 2313106 A | 11/1997 |
| WO | 2015001243 A2 | 1/2015 |

OTHER PUBLICATIONS

International Search Report dated Feb. 10, 2017.
Chinese Office Action dated Mar. 13, 2019.

*Primary Examiner* — Benjamin R Shaw
(74) *Attorney, Agent, or Firm* — Ipsilon USA, LLP

(57) ABSTRACT

An installation (1) comprising a storage zone (5) for storing the container (40) of the beverage for preparation; a liquid flow circuit (2) provided with at least one feed inlet (3) for feeding a beverage for preparation extending in said storage zone (5) and being provided with a perforation member (7); cooling and/or heating means (8) arranged along the liquid flow circuit (2); a sensor (13) for measuring the circuit temperature of the liquid flow circuit (2); and means (14) for providing a setpoint temperature corresponding to the tasting temperature desired for the beverage.
The installation (1) further comprises a sensor (6) for measuring the temperature of the container (40); a control unit (17) configured to control the cooling and/or heating means (8) as a function of the setpoint temperature, and of the measured temperatures; a closure member (18) for at
(Continued)

least partially closing access from the storage zone (5) to the perforation member (7), the closure member (18) being mounted to move between a closed position at least as a function of the measured temperature of the circuit.

15 Claims, 5 Drawing Sheets

(51) Int. Cl.

| | |
|---|---|
| ***B67B 7/00*** | (2006.01) |
| ***B67B 7/86*** | (2006.01) |
| ***B67D 1/07*** | (2006.01) |
| ***B67D 1/16*** | (2006.01) |
| ***B67D 3/00*** | (2006.01) |

(52) U.S. Cl.
CPC ..... *B67B 7/24* (2013.01); *B67D 1/07* (2013.01); *B67D 1/16* (2013.01); *B67D 3/0006* (2013.01); *B67D 3/0009* (2013.01); *B67D 3/0022* (2013.01); *B67D 3/0032* (2013.01); *B01F 2003/04872* (2013.01); *B01F 2215/0072* (2013.01); *B67B 7/28* (2013.01)

(56) References Cited

U.S. PATENT DOCUMENTS 4,874,023 A * 10/1989 Ulm ..... B67D 3/0019 141/346
4,877,065 A 10/1989 Lamboy et al.
5,042,690 A * 8/1991 O'Meara ..... A45D 34/042 206/15.2
5,366,619 A * 11/1994 Matsui ..... B67D 3/0009 210/139
5,421,159 A * 6/1995 Stokes ..... B67D 3/0009 62/3.64
5,567,322 A * 10/1996 Rundle ..... B67B 7/28 210/416.3
6,321,941 B1 * 11/2001 Argentieri ..... B05B 9/0861 222/81
6,442,960 B1 * 9/2002 Fournier ..... B67D 1/07 222/146.6
6,547,103 B1 * 4/2003 Elliott ..... B67D 3/0022 141/351
2002/0170921 A1 * 11/2002 Tan ..... B67D 1/1247 222/67
2004/0129723 A1 * 7/2004 Meder ..... B01D 3/02 222/113
2004/0154313 A1 * 8/2004 Taylor ..... B67D 3/0009 62/3.64
2005/0211728 A1 * 9/2005 Wang ..... B67D 3/0009 222/146.6
2006/0076286 A1 * 4/2006 Bolin ..... B67D 3/0009 210/282
2009/0057340 A1 * 3/2009 Moothart ..... B67D 3/0009 222/113
2009/0218370 A1 * 9/2009 Michels ..... B67B 7/28 222/185.1
2009/0320508 A1 * 12/2009 Linder ..... A47F 3/04 62/251
2010/0000931 A1 * 1/2010 Castillo ..... B67D 3/0009 210/266
2012/0248141 A1 * 10/2012 Sano ..... B67D 3/0003 222/67
2015/0075388 A1 * 3/2015 Deng ..... A47J 31/407 99/295
2016/0002020 A1 * 1/2016 Orita ..... B67D 1/0004 222/146.6
2016/0002022 A1 * 1/2016 Orita ..... B67D 3/0009 222/94
2016/0107874 A1 * 4/2016 Wang ..... B67D 1/07 222/1
2016/0175783 A1 * 6/2016 Jarrousse ..... B67D 3/0009 426/474
2017/0099980 A1 * 4/2017 Haidar ..... A47J 31/44
2017/0320718 A1 * 11/2017 Sherman ..... A23G 9/04
2017/0362073 A1 * 12/2017 Lee ..... F28D 7/02
2018/0334371 A1 * 11/2018 Trench ..... B67B 7/24

* cited by examiner

FACILITY FOR PREPARING A BEVERAGE FOR TASTING AND METHOD FOR OPENING A BEVERAGE CONTAINER USING SUCH A FACILITY

RELATED APPLICATION

This application is a National Phase of PCT/FR2016/053158, filed on Dec. 1, 2016, which claims the benefit of priority from French Patent Application No. FR 15 62002, filed on Dec. 8, 2015, the entirety of which are incorporated by reference.

FIELD OF THE INVENTION

The invention relates to an installation for preparing a beverage for tasting, in particular wine stored inside a container, and a method of opening a container using such an installation.

The invention relates more particularly to an installation for preparing a beverage for tasting, the installation comprising a storage zone for storing the container of the beverage for preparation; a liquid flow circuit provided with at least one feed inlet for feeding a beverage for preparation and with at least one dispensing outlet for dispensing the prepared beverage, the feed inlet for feeding a beverage extending in said zone for storing the container and being provided with a perforation member accessible to said container via the storage zone; cooling and/or heating means arranged along the liquid flow circuit in the portion of the liquid flow circuit referred to as the liquid flow circuit temperature control portion; a sensor for measuring the temperature referred to as the circuit temperature in the liquid flow circuit temperature control portion; and means for providing input data representative of a setpoint temperature corresponding to the tasting temperature desired for the beverage.

PRIOR ART

It is known that, in order to be fully appreciated, wines must be served under appropriate conditions. In particular, the optimum temperature is defined. It depends on the nature and on the origin of the wine. Certain white wines should be served very chilled (generally at about 7° C.), whereas certain red wines should be served at a temperature slightly lower than room temperature (and generally at about 18° C.). In addition, many wines, in particular red wines when they are young, improve by being oxidized a little by being exposed to air. Traditionally, such oxidation takes place by decanting the wine. Such constraints regarding preparing the wine before drinking it require wine lovers to make considerable preparations in advance. The bottle(s) need to be stored in a place at the correct temperature for several hours in advance, and, for wines that need to be oxidized, the bottles either need to be uncorked 6 to 12 hours in advance, or, for young wines that are still a little hard, the bottles need to be poured into a decanter about one hour before the wine is tasted. Such anticipation, which is necessary for tasting a good wine, is burdensome.

To overcome that problem, an installation of the above-mentioned type has been proposed and is described in international application no. WO2015/001243.

However, the design of that installation requires a flow of the beverage inside the liquid flow circuit to be fractionated, which increases the preparation time of said beverage and/or the length of the fluid flow circuit.

An object of the invention is to provide an installation of design that makes it possible to prepare the beverage in a short amount of time, without requiring fractionated flow of the beverage inside the installation.

SUMMARY

To this end, the invention provides an installation for preparing a beverage for tasting, in particular a wine stored inside a container, said installation comprising a storage zone for storing the container of the beverage for preparation; a liquid flow circuit provided with at least one feed inlet for feeding a beverage for preparation and with at least one dispensing outlet for dispensing the prepared beverage, the feed inlet for feeding a beverage extending in said zone for storing the container and being provided with a perforation member accessible to said container via the storage zone; cooling and/or heating means arranged along the liquid flow circuit in the portion of the liquid flow circuit referred to as the liquid flow circuit temperature control portion; a sensor for measuring the temperature referred to as the circuit temperature in the liquid flow circuit temperature control portion; and means for providing input data representative of a setpoint temperature corresponding to the tasting temperature desired for the beverage, the installation being characterized in that it further comprises a sensor for measuring the temperature of the container; a control unit configured to control the cooling and/or heating means as a function of the setpoint temperature, of the measured temperature of the container, and of the measured temperature of the circuit; and, in the zone for storing the container, a closure member for at least partially closing access from the storage zone to the perforation member, the closure member being mounted to move between a closed position in which the container is prevented from accessing the perforation member from the storage zone and an open position in which the container is able to access the perforation member from the storage zone, said closure member being suitable for passing from the closed position to the open position at least as a function of the measured temperature of the circuit.

The presence of a closure member in the zone for storing the container prevents access of the container to the member for opening the container, i.e. the perforation member, while the conditions, in particular in terms of circuit temperature of the liquid flow circuit are not satisfied. It is thus possible, when opening of the container is made possible, to be sure that the contents of said container can flow freely through the installation, since the liquid flow circuit has already been brought to the correct temperature. It is thus also guaranteed in certain manner that the final temperature of the beverage for preparation complies with recommendations.

In an embodiment, the control unit comprises means for determining "control" circuit temperature as a function of the setpoint temperature, of the measured temperature of the container, and of the measured temperature of the circuit, and means for controlling the cooling and/or heating means in order to obtain a measured circuit temperature in correspondence with the control circuit temperature, and said closure member is configured to pass from the closed position to the open position when the measured circuit temperature corresponds to the control circuit temperature.

In an embodiment, the closure member for preventing access to the perforation member from the storage zone is mounted to move between a closed position and an open position by means of a movement drive mechanism for said closure member that comprises at least one servomotor or equivalent actuator.

In an embodiment, the liquid flow circuit and the zone for storing the container are incorporated in a column-type structure inside which said liquid flow circuit extends with the feed inlet of the circuit for feeding a beverage for preparation being arranged at a level higher than the level of the dispensing outlet for dispensing the prepared beverage.

In an embodiment, the closure member for preventing access to the perforation member from the storage zone is a finger that extends transversely relative to the longitudinal axis of the column between the perforation member and the top of the column.

In an embodiment, the perforation member is provided with an air intake.

In an embodiment, the perforation member is formed by at least first and second needles, the second needle surrounds the first needle and is provided at its base with a step, and the installation includes an end stop for stopping perforation of the container by the perforation member, said end stop being configured to hold the container above and at a distance from the step of the second needle with a view to enabling the container to be come into contact with the surrounding air.

In an embodiment, the closure member for preventing access to the perforation member from the storage zone is a hollow member that also functions as a cleaning member by spraying fluid, said closure member being suitable for connection to a tank for storing a cleaning fluid by means of a fluid flow pipe that is preferably fitted with a pump. This results in an installation that is simple.

In an embodiment, the cooling and/or heating means are Peltier-effect cooling and/or heating means and comprise at least one Peltier-effect module.

In an embodiment, where it includes the cooling and/or heating means the liquid flow circuit is formed by a tube coil embedded in a block of a thermally conductive material, the outer peripheral surface of the block being in contact with the temperature control face of at least one Peltier-effect module.

In an embodiment, the installation includes a detector for detecting the presence of a container inside the storage zone and the pump is configured to be stopped when such presence is detected, so as to avoid any cleaning during a beverage preparation stage.

In an embodiment, the means for supplying data representative of the setpoint temperature corresponding to the tasting temperature desired for the beverage comprise data acquisition means and/or a data input interface or a human-machine interface (HMI), and/or a memory for storing one or more predefined item(s) of data.

In an embodiment, the data acquisition means comprise a contactless reader for reading a data medium that is suitable for being affixed on said container.

In an embodiment, said installation includes a cover that can be positioned to cover the end of the tube that is opposite from the end provided with the stopper, said cover forming a surface against which the hand of an operator can be pressing when the container is positioned inside the storage zone so that, when said closure member is in the open position, the container can be perforated merely by thrust being exerted on said container via the cover.

In an embodiment, the installation includes an audible and/or visual indicator indicating that the closure member for preventing access to the perforation member from the storage zone is passing from the closed position to the open position.

The invention also provides a method of opening a container for a beverage in the form of a tube closed by a stopper by means of an installation as described above, the method being characterized in that with the closure member for preventing access to the perforation member from the storage zone being in the closed position, said method comprises a step of driving movement of the closure member in the direction for allowing access to said perforation member, and a step of applying pressure on the container positioned in part inside the zone for storing the container towards the installation in the direction for driving the container in the direction of the perforation member with a view to piercing the container with said perforation member.

BRIEF DESCRIPTION OF THE DRAWINGS

The invention can be better understood on reading the following description of embodiments given with reference to the accompanying drawings, in which.

Figure 1:
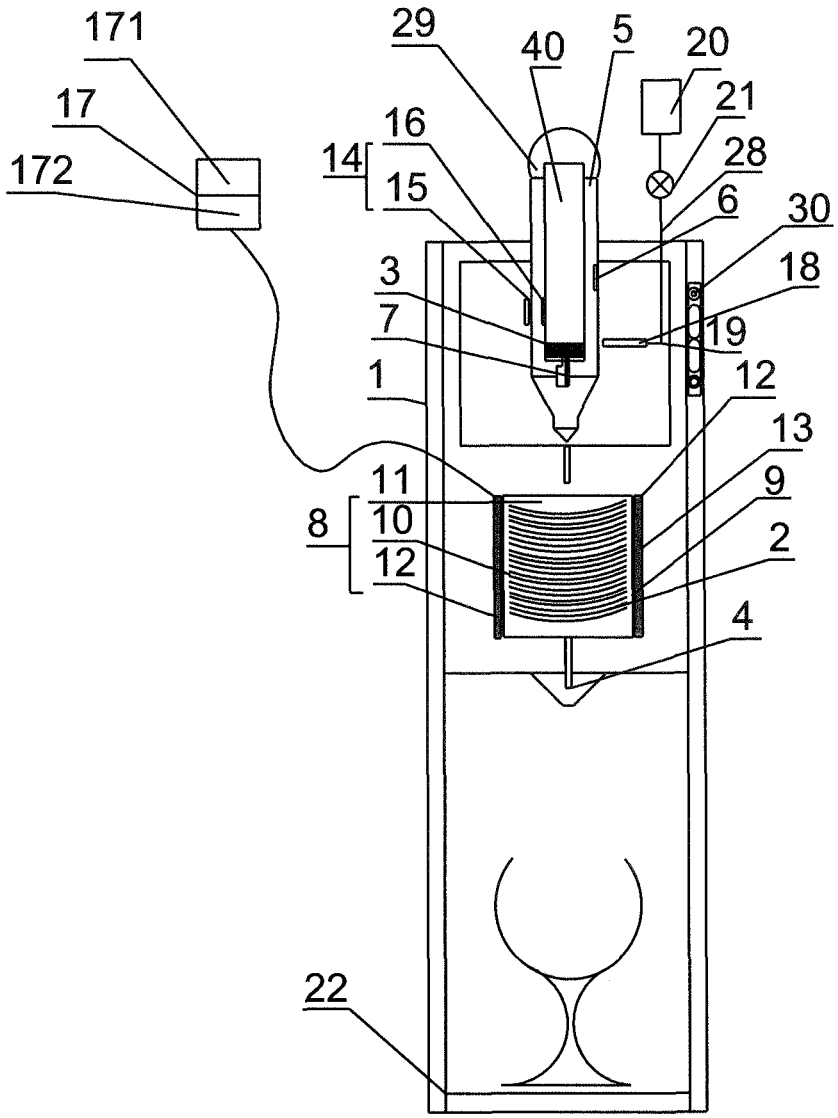
FIG. 1 is a diagrammatic view showing an installation of the invention, in the open position of the closure member.
Figure 2:
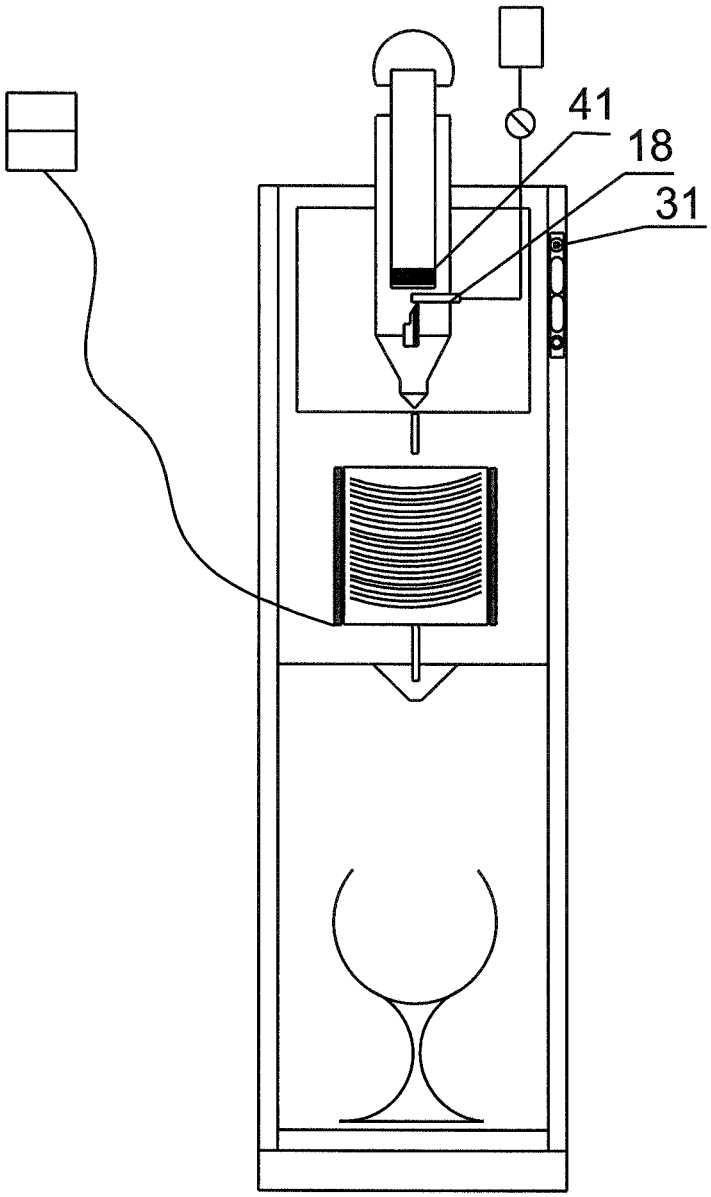
FIG. 2 is a diagrammatic view showing an installation of the invention, in the closed position of the closure member.
Figure 3A:
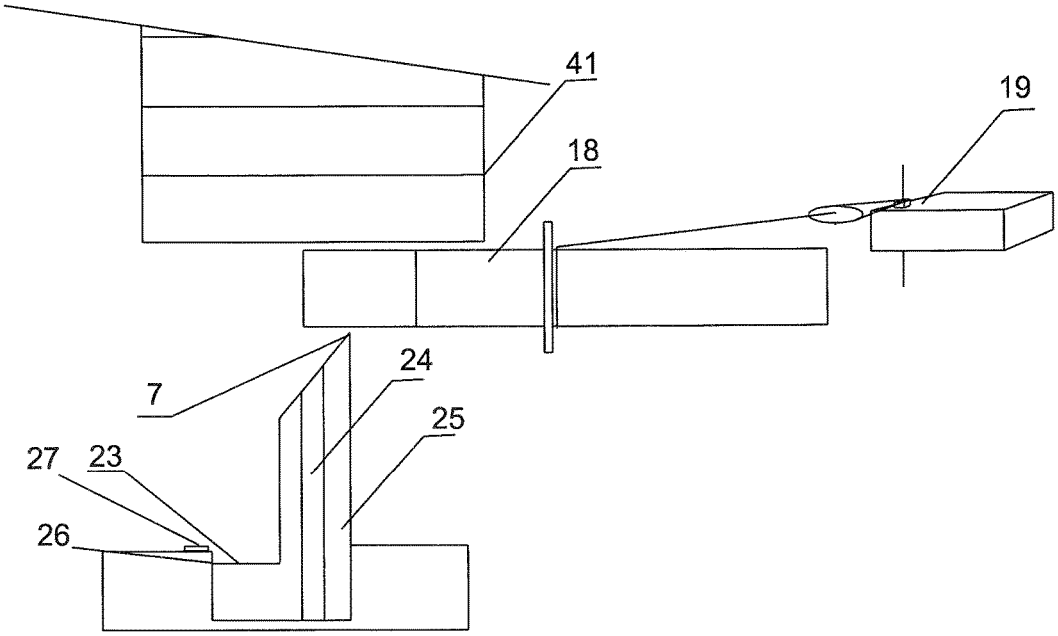
FIG. 3A is a diagrammatic view of the closure member and its associated mechanism for driving movement, with the access being in the closed position.
Figure 3B:
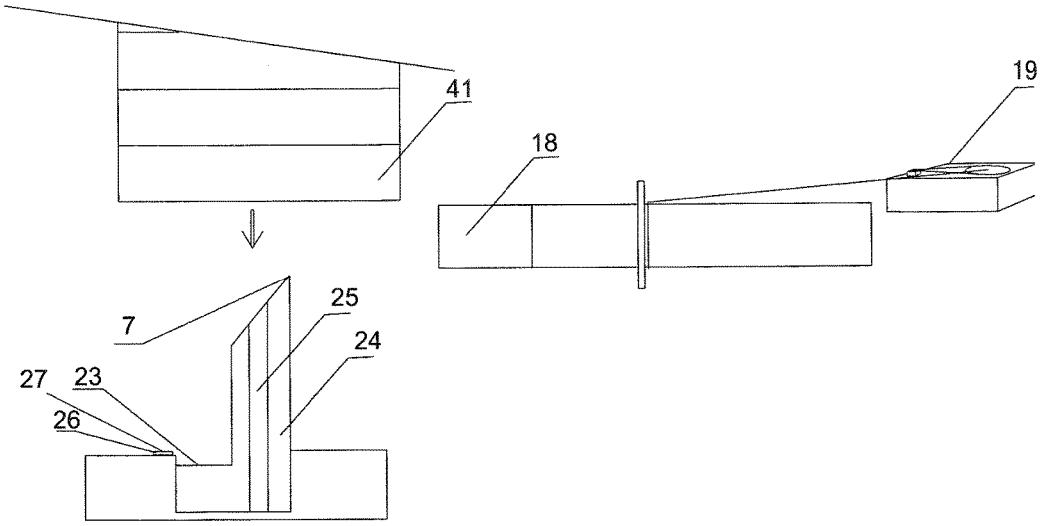
FIG. 3B is a diagrammatic view of the closure member and its associated mechanism for driving movement, with the access being in the open position.
Figure 4:
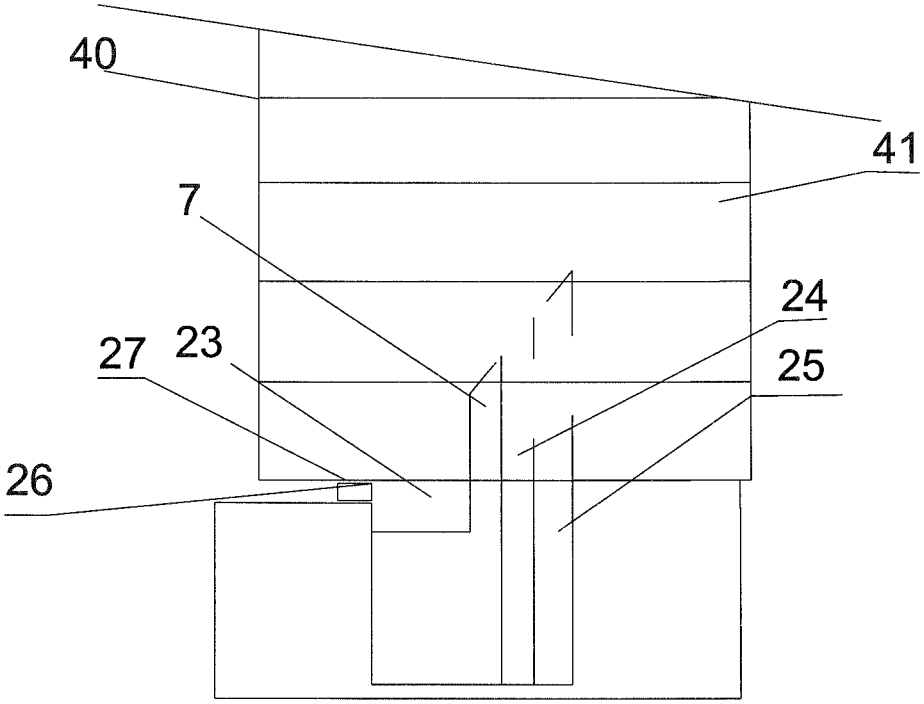
FIG. 4 is a diagrammatic view of the perforation member when said member is in the perforating state.
Figure 5:
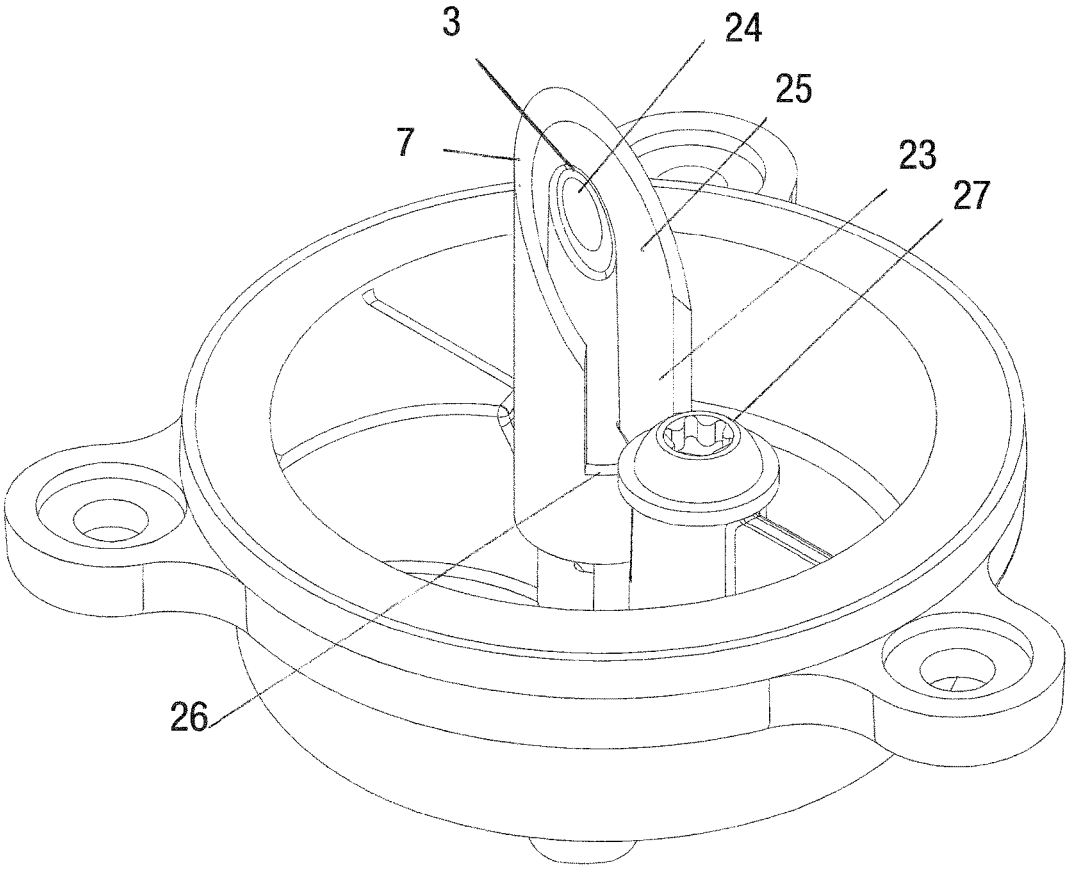
FIG. 5 is a perspective view of the perforation member.

As indicated above, the invention relates to an installation for preparing a beverage, in particular a wine, for tasting.

This installation 1 includes a liquid flow circuit 2 equipped with at least one feed inlet 3 for feeding a beverage for preparation, and at least one dispensing outlet 4 for dispensing the prepared beverage. This dispensing outlet 4 may be a single outlet or multiple outlets.

The installation further includes a storage zone 5 for storing the container 40 of the beverage for preparation, and the inlet 3 for feeding a beverage for preparation extends in said storage zone 5.

In the example shown, the liquid flow circuit 2 and the storage zone 5 for storing the container are incorporated in a column-type structure 22 inside which said liquid flow circuit 2 extends with the feed inlet 3 of the circuit for feeding a beverage for preparation being arranged at a level higher than the level of the dispensing outlet 4 for dispensing the prepared beverage so as to enable the beverage to flow by gravity through the flow circuit 2, which preferably extends in substantially vertical manner, as shown.

The column constituting the structure 22 is open at its top end, and the container 40 may be introduced into the storage zone 5, via the top end of the column that forms the entrance of the storage zone 5.

This container 40 may be a bottle, a tube, a vial, a metered-dose dispenser, or some other type of container. In the example shown, the container 40 is a wine-in-tube (wit) tube closed by a stopper 41 or a cover with a perforatable thin wall.

This container 40 is stored upside down, i.e. with its opening facing downwards inside the storage zone 5, so as to enable the container to be emptied by gravity.

The outlet 4 of the liquid flow circuit 2 is arranged vertically in register with and above a grating forming the top of a drip tray. The horizontally arranged grating serves as a surface for supporting a vessel, such as a glass, for collecting the prepared beverage. The associated drip tray serves to collect any surplus prepared beverage and prevents the surrounding environment from being soiled in the event of overflow. This drip tray also serves to collect cleaning fluid when means for cleaning the flow circuit are present.

In order to enable such a container 40 to be opened, the feed inlet 3 for feeding a beverage of the liquid flow circuit 2 is fitted with a perforation member 7, to which the container 40 has access passing via the storage zone 5.

The perforation member 7 is fitted with an air intake 23 to enable the container to be emptied.

In the example shown, the perforation member 7 is made up of a first needle 24 and of a second needle 25. The second needle 25 surrounds the first needle 24 and is provided, at its base, with a step 26. The installation 1 further includes an end stop 27 for stopping perforation of the container 40 by the perforation member 7. Said end stop 27 is configured to keep the container 40 above and at a distance from the step 26 of the second needle 25 with a view to enabling the container 40 to come into contact with the surrounding air. Said end stop 27 also makes it possible to keep the second needle 25 in position, thereby enabling the device to be more compact. By passing through the perforation member 7, the beverage reaches a chamber arranged at the base of the perforation member 7. The base of this chamber is extended by a tube coil 10 inside which the beverage flows before exiting the circuit via the free end of the tube coil 10. This free end of the circuit may be provided with a filter, preferably a removable filter, for retaining any impurities naturally present in the wine.

Going from the perforation member 7 towards the dispensing outlet 4 the liquid flow circuit 2 thus comprises a chamber and a tube coil 10.

Naturally, other embodiments of the flow circuit 2 could be envisaged without going beyond the ambit of the invention.

The liquid flow circuit 2 further comprises Peltier-effect cooling and/or heating means 8 arranged along the liquid flow circuit 2 in the portion of the liquid flow circuit 2 referred to as the liquid flow circuit 2 temperature control portion 9, and a sensor 13 for measuring a temperature referred to as the circuit temperature in the liquid flow circuit 2 temperature control portion 9.

Where it has the means 8 for cooling and/or heating, the liquid flow circuit 2 is formed by a tube coil 10.

The tube coil 10 is embedded in a block 11 of a thermally conductive material, such as a block of aluminum, enabling good casting and connection with the tube coil. The material of the tube coil is a conductive material known to be inert for wine, such as food grade stainless steel. The outer peripheral surface of the block 11 is in contact with the hot or cold temperature-control face of at least one Peltier-effect module 12.

In the example shown, two Peltier-effect cells or modules 12 are provided that are arranged on two facing portions of the outside surface of the pipe. These two Peltier-effect cells or modules, which are generally identical from one cell to another, are in the form of rectangles, each coupled for cooling purposes via its "cold" face to the outside surface of the block, via a thermal contact, such as a thermal adhesive or paste, or brazing.

Each of these cells or modules has an opposite "hot" face that is coupled, e.g. by adhesive, to a heat exchange block for exchanging heat with the environment surrounding the installation. Said heat exchange blocks may be thermally coupled with ambient air, either by air convection possibly stimulated by a fan, or else by a flow of fluid coming from and returning to a tank that itself acts as a thermal buffer and as a heat exchanger with ambient air. For heating purposes, the cold face of the module becomes its hot face, and vice versa for its hot face.

The Peltier-effect cells or modules are powered with direct current (DC) and, to this end, are connected to an electronic controller that houses a control unit 17 for controlling the cooling and/or heating means 8, operation of which is described in detail below.

It should be noted that the use of Peltier-effect cells or modules makes it possible firstly for the beverage flowing in the pipe to be cooled and/or heated rapidly, and secondly for the hot and cold faces of the cells or modules to be reversed merely by reversing the polarity.

This control unit 17 is configured to control the cooling and/or heating means 8 as a function of a setpoint temperature corresponding to the tasting temperature desired for the beverage, of the measured temperature of the container 40, and of the measured temperature of the circuit.

The installation therefore includes a sensor 6 for measuring the temperature of the container 40, which sensor in this embodiment is in the form of an infrared sensor arranged in the storage zone 5 of the container. Thus, as soon as the container 40 is introduced into said storage zone 5, its temperature can be measured by means of the temperature sensor 6, and the measured temperature is transmitted to a control unit 17.

In addition, in the liquid flow circuit 2 temperature control portion 9, the installation includes a temperature sensor 13 for measuring temperature, which sensor may be formed merely by a temperature probe arranged in the body of the block 11. Once again, the temperature measured by the sensor is transmitted to the control unit 17.

The installation further includes means 14 for supplying data representative of the setpoint temperature corresponding to the tasting temperature desired for the beverage. These means 14 for supplying data may comprise data acquisition means and/or a data input interface, also called a human-machine interface 31, and/or a memory for storing predefined data.

In the example shown, the data acquisition means comprise a contactless reader 15 for reading a data medium 16 that is suitable for being affixed on said container 40. The reader may be a radio-frequency identification (RFID) reader arranged in the storage zone 5, and the electronic data medium may be a radio tag affixed on said container and storing the setpoint temperature that is to be read by the reader. Thus, once again, as soon as the container 40 is introduced into the storage zone 5, the information about the setpoint temperature can be transmitted to the control unit 17.

In a variant, the means 14 for supplying data representative of the setpoint temperature could be formed merely by a graduated potentiometer knob. Naturally, this knob could be replaced by or associated with a digital-input keypad, or a display with up and down buttons making for raising or lowering the setpoint temperature. There could also be provided a data storage memory containing data in the form of a table associating, wine name, tasting temperature corresponding to the setpoint temperature, and optionally the aeration rate, in order to enable the user to determine the setpoint temperature by entering the name of a wine.

Provision could also be made for a version with optical reading of a bar code or a QR code.

A manual version in which the data is input manually to the installation by the operator via the human-machine interface on the basis of data indicated on the container of the beverage can also be envisaged.

The control unit 17 for controlling the cooling and/or heating means 8 comprises an electronic and/or computer unit such as a microprocessor associated with a working memory. When it is specified that this control unit is "configured to perform an action", that means that the microprocessor includes instructions for performing the action on the basis of the measured temperatures and of the setpoint temperature.

The control unit is thus configured to control powering of the cooling and/or heating means 8.

Generally, the control unit 17 comprises means 171 for determining a temperature of the control circuit as a function of the setpoint temperature, of the measured temperature of the container, and of the measured temperature of the circuit, and means 172 for controlling the cooling and/or heating means 8 in order to obtain a measured temperature of the circuit in correspondence with the temperature of the control circuit.

Generally, the Peltier-effect modules operate in on/off mode, and the control unit 17 thus controls the durations for which the modules are powered. The modules could also be fed with a variable current, requiring a variable-power regulator. It is thus assumed that a container having the radio tag indicates a setpoint temperature equal to 15° C. The measured temperature of the container in the storage zone 5 is 18° C. The circuit temperature measured in the temperature control portion of the circuit is 20°. After processing this data, the temperature of the control circuit is defined to be equal to 13° and the control unit controls powering of the Peltier-effect modules until said temperature is obtained in the temperature control portion 9 of the circuit as measured by the temperature sensor 13. When such a temperature is reached, an audible and/or visible indicator 30 alerts the user, who may now proceed with opening the container since the installation is at the correct temperature.

It should be observed that the wine may be cooler than the setpoint temperature. An example might come from a user who keeps tubes in a cool cellar and who wishes to taste a heady red wine that should be served at 18° C. Since operation of the Peltier elements is reversible, it suffices to reverse the DC for the wine that is to be cooled, so that the Peltier elements warm the beverage.

In order to avoid the user opening the container while the installation is not at the correct temperature, the installation includes, in the storage zone 5, a closure member 18 for at least partially closing access from the storage zone 5 to the perforation member 7. This closure member 18 is mounted to move between a closed position in which the container 40 is prevented from accessing the perforation member 7 from the storage zone, and an open position in which the container 40 is able to access the perforation member 7 from the storage zone 5.

The closure member 18 is suitable for passing from the closed position to the open position, at least as a function of the measured temperature of the circuit.

In the example shown, the member 18 for closing access from the storage zone 5 to the perforation member 7 is a finger that extends transversely relative to the longitudinal axis of the column between the perforation member 7 and the top of the column, and the member 18 for closing access from the storage zone 5 to the perforation member 7 is mounted to move between a closed position and an open position by means of a drive mechanism for driving movement of said closure member 18 and comprising at least one servo-motor 19 or equivalent actuator.

This drive mechanism includes a pivot member that pivots under the action of the servomotor 19, said pivot member being interposed between the servomotor and the closure member 18.

The control unit for controlling the drive mechanism for driving movement of the closure member 18, and in particular for controlling the servomotor 19, may be common to the control unit 17 for controlling the cooling and/or heating means 8, or it may be incorporated in said servomotor. Regardless of the design of the control unit, it is configured to act, via the servomotor 19, to cause the closure member 18 to pass from its closed position to its open position when the temperature of the circuit measured by the temperature sensor 13 corresponds with the temperature of the control circuit and, for example, is not less than the temperature of the control circuit. Thus, the user may drive the container 40 further into the storage zone 5, until the container 40 is perforated by the perforation member 7. Since the installation is brought to the correct temperature and the closure member 18 is passed from the closed position to the open position at the same time, the audible and/or visible indicators 30 that indicate to the operator that the installation has been brought to the correct temperature also indicate that the member 18 for closing access from the storage zone 5 to the perforation member 7 has passed from the closed position to the open position.

In order to enable thrust to be exerted on the container under good conditions, said installation 1 includes a cover 29 that can be positioned to cover the end of the tube that is opposite from its end provided with the stopper 41. Said cover 29 forms a surface suitable for being pressed against by the hand of an operator when the container 40 is positioned inside the storage zone 5 so that, when said closure member 18 is in the open position, the container 40 can be perforated merely by thrust being exerted on said container 40 via the cover 29.

In this embodiment, the cover 29 is present in the form of a ball or sphere provided with a recess via which the ball covers the end of the container 40 projecting from the storage zone 5 of the container.

Finally, to finish off the installation, the member 18 for closing access from the storage zone 5 to the perforation member is also a cleaning member for cleaning by spraying fluid. Said closure member 18 is suitable for connection to a tank 20 for storing a cleaning fluid by means of a fluid flow pipe 28 that is preferably fitted with a pump 21.

The RFID reader fitted on the storage zone can act as a detector for detecting the presence of a container 40. Thus, when no container is detected, it can proceed with a cleaning cycle for the liquid flow circuit 2. This cleaning cycle is preferably controlled manually by the operator, by actuating the pump. The tank for cleaning fluid may be mounted in removable manner on the installation.

Opening a container 40 and emptying it into a glass positioned underneath the outlet 4 of the liquid flow circuit 2 of the installation is performed as follows: When the closure member 18 is in the closed position, the container 40 is inserted upside down into the storage zone 5, until it reaches a position in abutment against said closure member 18. The temperature of the container 40 and the setpoint temperature are measured or detected and together with the measured temperature of the liquid flow circuit 2 temperature control portion 9, they are processed by the control unit 17 in order to determine the temperature of the control circuit. Once this temperature of the control circuit has been reached in the liquid flow circuit temperature control portion 9, the closure member 18 is driven to move in the opening direction, and a light or audible indicator 30 indicates to the user that the installation has been brought to the correct temperature. The user applies pressure to the container 40 positioned partly inside the zone 5 for storing the container of the installation in the direction for driving the container 40 in the direction of the perforation member 7 with a view to perforating the container 40 with said perforation member 7. Once the stopper of the container has been perforated, the contents of the container feeds the liquid flow circuit 2 and is brought to the correct temperature in the temperature control portion of said circuit before exiting the circuit and dropping into a glass or more than one glass for a circuit having multiple outlets. Preparation of the beverage is complete.

Three steps of aeration take place when serving the beverage, allowing it to reveal its aromas. First aeration takes place as the wine is flowing once the container 40 has been perforated. Specifically, air rising to the top of the container provides a first exposure. The wine leaving the chamber 5 adds second aeration, which may be boosted before or after by a Venturi effect system. A third aeration takes place as the wine is flowing into the glass, the outlet pipe 4 being narrow enough to create a thin stream, with a surface to volume ratio that is large and creates final aeration.

Once the container has been removed from the storage zone 5, a cleaning cycle may be performed, before a new container is emptied. The cleaning cycle begins with the closure member 18 in the closed position. This closure member 18 takes up the closed position as soon as the emptied container is extracted from the column-type structure. Such extraction is detected by means of the RFID reader.

The invention claimed is:

1. An installation for preparing a beverage for tasting, in particular a wine stored inside a container, said installation comprising:

a storage zone for storing the container of the beverage for preparation;

a liquid flow circuit provided with at least one feed inlet for feeding a beverage for preparation and with at least one dispensing outlet for dispensing the prepared beverage, the feed inlet for feeding a beverage extending in said zone for storing the container and being provided with a perforation member accessible to said container via the storage zone;

cooling and/or heating means arranged along the liquid flow circuit in the portion of the liquid flow circuit referred to as the liquid flow circuit temperature control portion;

a sensor for measuring the temperature referred to as the circuit temperature in the liquid flow circuit temperature control portion; and means for providing input data representative of a setpoint temperature corresponding to the tasting temperature desired for the beverage;

wherein said installation further comprises a sensor for measuring the temperature of the container;

a control unit configured to control the cooling and/or heating means as a function of the setpoint temperature, of the measured temperature of the container, and of the measured temperature of the circuit; and, in the zone for storing the container, a closure member for at least partially closing access from the storage zone to the perforation member, the closure member being mounted to move between a closed position in which the container is prevented from accessing the perforation member from the storage zone and an open position in which the container is able to access the perforation member from the storage zone, said closure member being suitable for passing from the closed position to the open position at least as a function of the measured temperature of the circuit.

2. An installation according to claim 1, wherein the control unit comprises means for determining a "control" circuit temperature as a function of the setpoint temperature, of the measured temperature of the container, and of the measured temperature of the circuit, and means for controlling the cooling and/or heating means in order to obtain a measured circuit temperature in correspondence with the control circuit temperature, and in that said closure member is configured to pass from the closed position to the open position when the measured circuit temperature corresponds to the control circuit temperature.

3. An installation according to claim 1, wherein the closure member for preventing access to the perforation member from the storage zone is mounted to move between a closed position and an open position by means of a movement drive mechanism for said closure member that comprises at least one servomotor.

4. An installation according to claim 1, wherein that the liquid flow circuit and the zone for storing the container are incorporated in a column-type structure inside which said liquid flow circuit extends with the feed inlet for feeding a beverage for preparation arranged at a level higher than the level of the dispensing outlet for dispensing the prepared beverage.

5. An installation according to claim 4, wherein the closure member for preventing access to the perforation member from the storage zone is a finger that extends transversely relative to the longitudinal axis of the column between the perforation member and the top of the column.

6. An installation according to claim 1, wherein the perforation member is provided with an air intake.

7. An installation according to claim 1, wherein the perforation member is formed by at least first and second needles, in that the second needle surrounds the first needle and is provided at its base with a step, and in that the installation includes an end stop for stopping perforation of the container by the perforation member, said end stop being configured to hold the container above and at a distance from and above the step of the second needle with a view to enabling the container to be come into contact with the surrounding air.

8. An installation according to claim 1, wherein the closure member for preventing access to the perforation member from the storage zone is a hollow member that also functions as a cleaning member by spraying fluid, said closure member being suitable for connection to a tank for storing a cleaning fluid by means of a fluid flow pipe that is preferably fitted with a pump.

9. An installation according to claim 1, wherein the cooling and/or heating means are Peltier-effect cooling and/or heating means and comprise at least one Peltier-effect module.

10. An installation according to claim 9, wherein said installation includes the cooling and/or heating means the liquid flow circuit is formed by a tube coil embedded in a block of a thermally conductive material, the outer peripheral surface of the block being in contact with the temperature control face of at least one Peltier-effect module.

11. An installation according to claim 7, wherein the means for supplying data representative of the setpoint temperature corresponding to the tasting temperature desired for the beverage comprise data acquisition means and/or a data input interface or a human-machine interface, and/or a memory for storing one or more predefined item(s) of data.

12. An installation according to claim 11, wherein the data acquisition means comprise a contactless reader for reading a data medium that is suitable for being affixed on said container.

13. An installation according to claim 1, of the type of which said container is a tube, closed by a stopper, positioned upside down inside the zone for storing the container, with the stopper positioned facing the perforation member, characterized in that said installation includes a cover that can be positioned to cover the end of the tube that is opposite from the end provided with the stopper, said cover forming a surface against which the hand of an operator can be pressing when the container is positioned inside the storage zone so that, when said closure member is in the open position, the container can be perforated merely by thrust being exerted on said container via the cover.

14. An installation according to claim 1, wherein said installation includes an audible and/or visual indicator indicating that the closure member for preventing access to the perforation member from the storage zone is passing from the closed position to the open position.

15. Method of opening a container for a beverage in the form of a tube closed by a stopper by means of an installation in accordance with claim 1, wherein, with the closure member for preventing access to the perforation member from the storage zone being in the closed position, said method comprises a step of driving movement of the closure member in the direction for allowing access to said perforation member, and a step of applying pressure on the container positioned in part inside the zone for storing the container of the installation in the direction for driving the container towards the perforation member with a view to perforating the container with said perforation member.

* * * * *